US005604505A

United States Patent [19]

Matterer

[11] Patent Number: 5,604,505

[45] Date of Patent: Feb. 18, 1997

[54] PHASE TUNING TECHNIQUE FOR A CONTINUOUS TRANSVERSE STUB ANTENNA ARRAY

[75] Inventor: Veronica P. Matterer, Culver City, Calif.

[73] Assignee: Hughes Electronics, Los Angeles, Calif.

[21] Appl. No.: 607,060

[22] Filed: Feb. 26, 1996

[51] Int. Cl.[6] ..... H01Q 13/20

[52] U.S. Cl. ..... 343/772; 343/783; 343/767

[58] Field of Search ..... 343/772, 767, 343/783, 777, 785, 768, 850; H01Q 13/00, 13/20, 13/22, 13/24, 13/26

[56] References Cited

U.S. PATENT DOCUMENTS

| | | | |
|---|---|---|---|
| 5,266,961 | 11/1993 | Milroy | 343/772 |
| 5,349,363 | 9/1994 | Milroy | 343/785 |
| 5,361,076 | 11/1994 | Milroy | 343/772 |
| 5,483,248 | 1/1996 | Milroy | 343/785 |

*Primary Examiner*—Michael C. Wimer
*Attorney, Agent, or Firm*—Leonard A. Alkov; Wanda K. Denson-Low

[57] ABSTRACT

A continuous transverse stub antenna array that comprises phase tuning sections disposed between adjacent stub elements. The antenna array includes a sheet of dielectric material having a plurality of transverse stub elements extending from a first surface thereof. A first metal layer is disposed on the first surface and side surfaces of each of the stub elements, and a second metal layer is disposed on a second surface of the sheet of dielectric material that forms a ground plane of the array. A plurality of tuning sections are formed in the sheet of dielectric material and are disposed between each of the stub elements that extend laterally across the sheet of dielectric material. The plurality of tuning sections have a cross sectional shape in the form of an inverted T. Each of the tuning section comprises a first parallel plate section comprising dielectric material, a first quarter-wavelength transformer section, a second parallel plate section that is partially filled with dielectric material. a second quarter-wavelength transformer section that is partially filled with dielectric material, a third parallel plate section, and a second stub element that is completely filled with dielectric material. The widths of the first and third parallel plate sections and the widths of the first and second quarter-wavelength transformer sections are substantially the same. Varying the width dimension of the second parallel plate section tunes the phase between the adjacent stub elements.

4 Claims, 1 Drawing Sheet

PHASE TUNING TECHNIQUE FOR A CONTINUOUS TRANSVERSE STUB ANTENNA ARRAY

BACKGROUND OF THE INVENTION

The present invention relates to continuous transverse stub antenna arrays, and more particularly, to the use of phase tuning sections in a continuous transverse stub antenna array that permit phase tuning of each element so that the elements may be spaced periodically.

Continuous transverse stub antenna arrays are described in U.S. Pat. No. 5,266,961 issued Nov. 30, 1993, entitled "Continuous Transverse Stub Element Devices and Method of Making Same ", U.S. patent application Ser. No. 08/104, 020 filed Aug. 10, 1993, entitled "Continuous Transverse Stub Element Antenna Arrays", both of which are assigned to the assignee of the present invention. The elements of the continuous transverse stub antenna array must be tuned in order to optimize the performance of the array.

The current method of tuning each element is to vary the spacing between adjacent antenna elements. Once the elements are shifted to account for tuning, the amplitude and phase of the array requires adjustment. By a process of iteration, the interpolated amplitude and phase of each element is obtained. The result is an array that is aperiodic in spacing and approximate in amplitude and phase at each element.

The disadvantages of aperiodic arrays are that their antenna patterns have wider beamwidths, higher side-lobe levels, and consequently, lower gain than equivalent periodically spaced arrays. The present invention eliminates the need to vary the spacing between antenna elements in a continuous transverse stub antenna array.

Therefore, it is an objective of the present invention to provide for a continuous transverse stub antenna array that uses phase tuning sections to phase tune each element so that the elements may be spaced periodically.

SUMMARY OF THE INVENTION

In order to meet the above and other objectives, the present invention is a continuous transverse stub antenna array that comprises phase tuning sections disposed between adjacent stub elements. More specifically, the present invention provides for a continuous transverse stub antenna array that includes a sheet of dielectric material having a plurality of transverse stub elements extending from a first surface thereof. A first metal layer is disposed on the first surface and side surfaces of each of the stub elements, and a second metal layer is disposed on a second surface of the sheet of dielectric material that forms a ground plane of the array. A plurality of tuning sections are formed in the sheet of dielectric material and are disposed between each of the stub elements. The plurality of tuning sections extend laterally across the sheet of dielectric material along the dimension of the stub elements. The plurality of tuning sections have a cross sectional shape in the form of an inverted T, and the ground plane encloses each of the tuning sections.

Each of the tuning section comprises a first parallel plate section disposed adjacent to a first stub element that is comprised of dielectric material. A first quarter-wavelength transformer section is disposed adjacent to the first parallel plate section. A second parallel plate section is disposed adjacent to the first quarter-wavelength transformer section that is partially filled with dielectric material. A second quarter-wavelength transformer section disposed adjacent to the second parallel plate section that is partially filled with dielectric material. A third parallel plate section disposed between the second quarter-wavelength transformer section and a second stub element that is completely filled with dielectric material. The widths of the first and third parallel plate sections and the widths of the first and second quarter-wavelength transformer sections are substantially the same. Varying the width dimension of the second parallel plate section tunes the phase between the adjacent stub elements.

The use of the phase tuning sections between elements of the continuous transverse stub antenna array allows the elements to be periodically spaced. The phase tuning sections are used to phase tune each element in the continuous transverse stub antenna array so that the elements in the array can be spaced periodically.

By employing the present phase tuning sections between elements of a continuous transverse stub antenna array, the following advantages are achieved. Improved beamwidth and improved side-love level performance are achieved due to the periodic spacing and increased accuracy in the element excitation. Improved efficiency is achieved since the air regions are less lossy than solid dielectric regions. Improved gain is achieved due to decreased beamwidth, reduced side-lobe levels, and improved efficiency.

The phase tuning sections are easily machined in the continuous transverse stub antenna array, and are therefore cost effective. The phase tuning sections are easily modeled using a High Frequency Structure Simulator available from Hewlett-Packard Company.

Since a solid metal back-plate replaces the copper plating on the back of the array, the rigidity of the antenna is improved. Another advantage of using a metal back-plate is that the time in which the array is exposed to high temperatures during the plating process is reduced, thereby decreasing the chance for warpage in the array.

The time required for producing a working array is also reduced. With aperiodic spacing, interpolation of element excitation is required. The accuracy of the interpolation is not known until an aperture is fabricated and may require one or two iterations. Use of the present tuning sections eliminates at least one of these iterations since the element excitation is known exactly from the beginning of the design process.

Employing the present tuning sections in continuous transverse stub antenna arrays provides for a lower cost highly efficient antenna arrays and reduces the cycle time from design to production.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DESCRIPTION OF THE PREFERRED EMBODIMENTS

Figure 1:
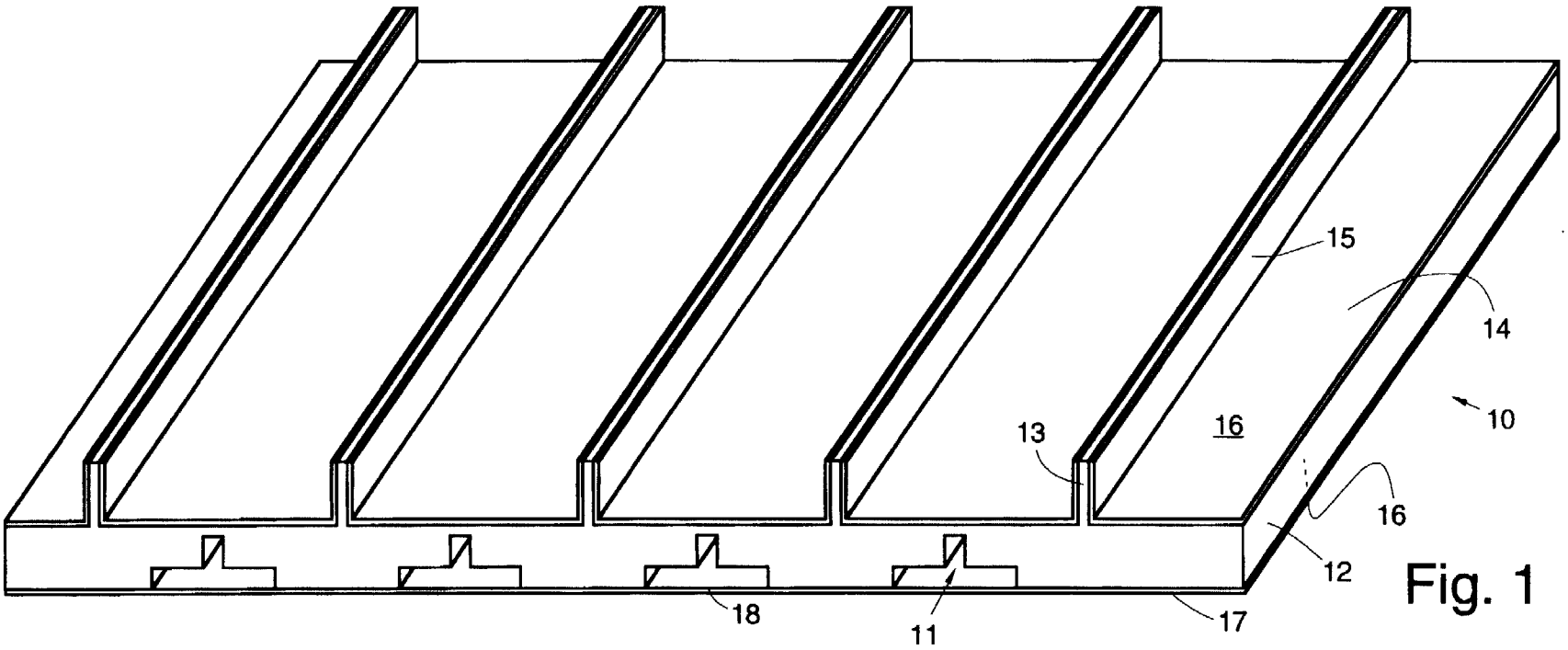
FIG. 1 illustrates a perspective view of a continuous transverse stub antenna array hat employs tuning sections in accordance with the principles of the present invention.

Referring to the drawing figures, FIG. 1 illustrates a perspective view of a continuous transverse stub antenna array 10 that employs tuning sections 11 in accordance with the principles of the present invention. As is shown in FIG. 1, the continuous transverse stub antenna array 10 is comprised of a sheet of dielectric material 12 that has a plurality of transverse stub elements 13 extending from a first surface 14 thereof. The first surface 14 and side surfaces 15 of each of the stub elements 13 is plated or otherwise has a first metal layer 16 disposed thereon. A second surface 17 or bottom surface 17 of the sheet of dielectric material 12 has a second metal layer 16 disposed thereon that forms a ground plane 18 of the array 10.

Additional details regarding continuous transverse stub antenna arrays 10 may be found in U.S. Pat. No. 5,266,961 issued Nov. 30, 1993, entitled "Continuous Transverse Stub Element Devices and Method of Making Same", and U.S. patent application Ser. No. 08/104,020 filed Aug. 10, 1993, entitled "Continuous Transverse Stub Element Antenna Arrays", both of which are assigned to the assignee of the present invention, the contents of which are incorporated herein by reference.

A plurality of tuning sections 11 are formed in the sheet of dielectric material 12 and are disposed between each of the stub elements 13. Each of the plurality of tuning sections 11 have a cross sectional shape in the form of an inverted "T". The plurality of tuning sections 11 are disposed adjacent the second surface 17 of the sheet of dielectric material 12 and extend laterally across the sheet of dielectric material 12 along the dimension of the stub elements 13. Consequently, the second metal layer 16 that forms the ground plane 18 of the array 10 encloses each of the tuning sections 11.

Figure 2:
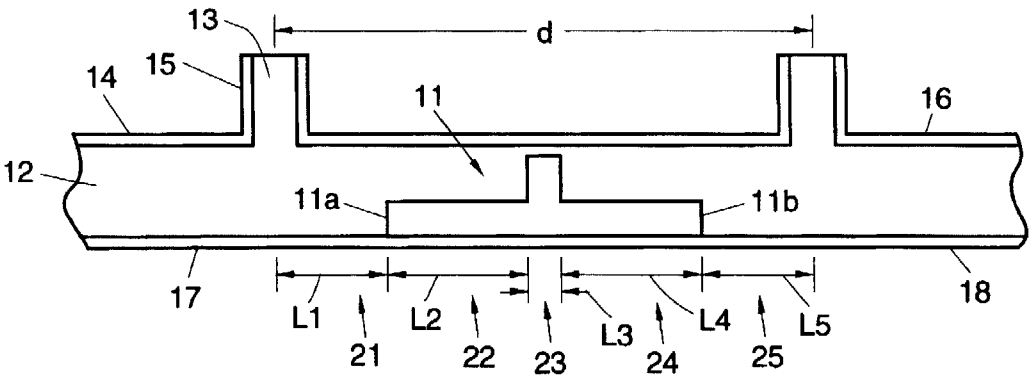
FIG. 2 illustrates details of an exemplary tuning section in accordance with the present invention employed in the continuous transverse stub antenna array of FIG. 1.

FIG. 2 illustrates details of an exemplary tuning section 11 in accordance with the present invention employed in the continuous transverse stub antenna array 10 of FIG. 1. Referring to FIG. 2, the periodic spacing between centers of adjacent stub elements 13 of the array 10 may be defined as d. L1 defines the dimension of a first parallel plate section 21 that is comprised of dielectric material 12. The first parallel plate section 21 is disposed between the center of a first stub element 13 and a first edge 11*a* of the tuning section 11. The first parallel plate section 21 has a wavelength given by $\lambda_{d1}$. L2 defines the dimension of a first quarter-wavelength transformer section 22 of the tuning section 11. The first quarter-wavelength transformer section 22 has a wavelength given by $\lambda_{d2}$, $L2=\lambda_{d2}/4$. L3 defines the dimension of a second parallel plate section 23 of the tuning section 11 that is partially filled with dielectric material 12. The second parallel plate section 23 has a wavelength $=\lambda_{d3}$. L4 defines the dimension of a second quarter-wavelength transformer section 24 that is partially filled with dielectric material 12. The second quarter-wavelength transformer section 24 has a wavelength given by $\lambda_{d2}$, and $L4=\lambda_{d2}/4$. L5 defines the dimension of a third parallel plate section 25 of the tuning section 11 that is disposed between the center of a second stub element 13 and a second edge 11*b* of the tuning section 11, that is completely filled with dielectric material 12. The third parallel plate section 25 has a wavelength given by $\lambda_{d1}$.

The relationships between the dimensions of the above-defined sections 21–25 are:

$\lambda_{d1}<\lambda_{d2}<\lambda_{d3}$, $\lambda_{d2}=(\lambda_{d1}\times\lambda_{d3})^{1/2}$,

L1=L5,

L2=L4, and

L1+L2+L3+L4+L5=d.

As should be readily apparent to those skilled in the art, by varying the width dimension L3, the phase between adjacent stub elements 13 may be tuned to accommodate a complex excitation distribution or to tone out the phase difference between stub elements 13 having different dimensions width in a purely-real excitation distribution.

Thus there has been described a new and improved continuous transverse stub antenna array that uses tuning sections to phase tune each element so that the elements may be spaced periodically. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A continuous transverse stub antenna array comprising:

a sheet of dielectric material;

a plurality of transverse stub elements extending from a first surface of the sheet of dielectric material;

a first metal layer disposed on the first surface and side surfaces of each of the stub elements;

a second metal layer disposed on a second surface of the sheet of dielectric material that forms a ground plane of the array;

a plurality of tuning sections formed in the sheet of dielectric material that are disposed between each of the stub elements that extend laterally across the sheet of dielectric material along the dimension of the stub elements, and that have a cross sectional shape in the form of an inverted T, and wherein the ground plane encloses each of the tuning sections.

2. The antenna of claim 1 wherein centers of adjacent stub elements are separated by a distance d and wherein the tuning section disposed therebetween comprises:

a first parallel plate section disposed adjacent to a first stub element that is comprised of dielectric material;

a first quarter-wavelength transformer section disposed adjacent to the first parallel plate section;

a second parallel plate section disposed adjacent to the first quarter-wavelength transformer section that is partially filled with dielectric material;

a second quarter-wavelength transformer section disposed adjacent to the second parallel plate section that is partially filled with dielectric material; and a third parallel plate section disposed between the second quarter-wavelength transformer section and a second stub element that is completely filled with dielectric material.

3. The antenna of claim 1 wherein the widths of the first and third parallel plate sections are substantially the same, and wherein the widths of the first and second quarter-wavelength transformer sections are substantially the same, and wherein varying the width dimension of the second parallel plate section tunes the phase between the adjacent stub elements.

4. The antenna of claim 1 wherein:

the first parallel plate section has a wavelength given by $\lambda_{d1}$;

the first quarter-wavelength transformer section has a wavelength given by $\lambda_{d2}$ and whose width L2 is given by $\lambda_{d2}/4$;

the second parallel plate section has a wavelength given by $\lambda_{d3}$;

the second quarter-wavelength transformer section has a wavelength given by $\lambda_{d2}$, and whose width L4 is given by $\lambda_{d2}/4$; and the third parallel plate section has a wavelength given by $\lambda_{d1}$;

and wherein $\lambda_{d1}<\lambda_{d2}<\lambda_{d3}$, $\lambda d2=(\lambda_{d1}\times\lambda_{d3})^{1/2}$, L=L5, L2=L4, and L1+L2+L3+L4+L5=d.

* * * * *